United States Patent [19]

Shorter, Jr.

[11] 4,085,696

[45] Apr. 25, 1978

[54] UTILITY CHASE FOR FLOATING UNITS

[76] Inventor: Myron L. Shorter, Jr., 834 Vallejo Rd., Novato, Calif. 94947

[21] Appl. No.: 737,496

[22] Filed: Nov. 1, 1976

[51] Int. Cl.[2] ..... B63B 35/44

[52] U.S. Cl. ..... 114/266; 114/267

[58] Field of Search ..... 114/266, 267, 263, 77 R, 114/61; 61/48

[56] References Cited

U.S. PATENT DOCUMENTS

| | | | |
|---|---|---|---|
| 3,009,326 | 11/1961 | Williams | 61/48 |
| 3,289,621 | 12/1966 | Sebring | 114/266 |
| 3,442,238 | 5/1969 | Oost | 114/263 |
| 3,448,709 | 6/1969 | Hardwick, Jr. | 114/266 |
| 3,760,754 | 9/1973 | Drummond | 114/266 |

*Primary Examiner*—Trygve M. Blix
*Assistant Examiner*—Sherman D. Basinger
*Attorney, Agent, or Firm*—Bielen and Peterson

[57] ABSTRACT

A utility chase for floating units which utilizes at least a pair of spaced float units each having a flange structure spaced from one another. A pair of stringers mounts against a side of the flange structures, one on each flange structure. A bar spans the space between units and is fastened by a rod element which secures the stringers, flange structures and rod in compression.

20 Claims, 2 Drawing Figures

UTILITY CHASE FOR FLOATING UNITS

BACKGROUND OF THE INVENTION

This invention relates to a novel utility chase for floating units, generally cooperating to form a floating dock or wharf. Watercraft marines employ a large number of float units interconnected to provide mooring and shelter for boats. Floating units are less expensive than permanent piers to install and maintain. Also, arrangement, as well as the feature of adjustability to tidal levels. Boats moored on floating docks always remain at a convenient level in relation to the upper walkway of the floating dock.

Boat marines often supply services to the craft near the extremity of the floating dock array. The source of such services, such as water, gasoline, air, electricity, and the like lie ashore. Consequently, conduits must run from the service point to the land source.

In the past, brackets, hooks, hangers and the like have run along the side of the interconnected float units to support conduits. This has proved unsatisfactory for a number of reasons. For instance, the utility conduits interfere with the movement and docking of water craft. Likewise, watercraft often damage the utility conduits during normal movement, simply by the force of wave and water action on the tied up craft. Prior supports could not handle large and multiple utility lines without expensive and elaborate reinforcements, as well as a redesigning of the float unit to accomodate such increased support capacity.

SUMMARY OF THE INVENTION

In accordance with the present invention a utility chase for float units is provided utilizing a plurality of float units, each having a flange structure projecting therefrom along a side. The flange structure of each unit has a first and second side. The float units space from one another such that the flange units space apart also.

A first stringer mounts against the first side of the flange structure of a first float unit while a second stringer mounts against the first side of a second float unit. Between the flange structures of the first and second float units, is placed at least one bar to span the space or gap therebetween. This bar mounts either against the first or second side of the flange structures of both float units.

Fastening means secures, in compression, the flange structure, stringer, and portion of the spanning bar in each of the float units. The fastening means includes a rod element extending through the sandwiched flange structure, stringer and spanning bar portion on each float unit.

The invention may also have a third and fourth stringer mounted against the second sides of both float units. Another bar may then mount against the second sides of the spaced flange structures, such that one bar and another bar space from each other to accomodate utility conduits between such a gap or space. A panel may be removable positioned atop another bar to provide a walkway commesurate with the top surface of both float units. Of course, the two bars may include a multiplicity of such bars along the flange structure of the two float units creating a partially enclosed tunnel below the deck level of the float units.

The invention's scope may be deemed to encompass a third and fourth float unit with the third float unit abutting the first float unit and the fourth float unit abutting the second float unit. In which case, the first stringer and the second stringer may be extended against the first sides of the flange structures of the third and fourth units; the third and fourth float units flange structures spaced in essentially the same manner, but not necessarily the same distance as, the flange structures of the first and second float units.

At the intersection of the first, second, third, and fourth float units, a first crossbrace may be included. The crossbrace runs between either the first and fourth float units or the second and third float units, ie: diagonally across the intersection of the float units. Such a crossbrace mounts against either the first side or second side of the first and second stringers. Likewise, a second crossbrace mounts against either the first or second sides of the flange structures, diagonally spanning the float unit intersection, but oppositely with respect to the float units traversed by the first crossbrace. In other words, if the first crossbrace spans the first and fourth float units, the second crossbrace spans the second and third float units. The crossbraces may be secured at portions between their mounting points to provide better support.

The third and fourth stringers may extend to the third and fourth float units and be held in compression against the second sides of the flange structures of these units by the fastening means.

Thus it may be seen that a novel utility chase has been described which will permit the directing of utility conduits between spaced float units.

It is therefore an object of the present invention to provide a utility chase for floating units which allows the accomodation of conduits, pipes, tubes and the like from the extremity of the float units to another extremity of the float units which may be communicative with a shore source or repository of the utility service.

Another object of the present invention is to provide a utility chase for floating units which does not interfere with the operation of watercraft, yet provides the necessary services for the same.

Yet another object of the present invention is to provide a utility chase for floating units which permits the placement of conduits below the deck surface of such floating units and permits easy access to the floating units for repair, maintenance, alteration, and the like, of the utility conduits.

Still another object of the present invention is to provide a utility chase for floating units which is compatable with connection methods commonly employed to interconnect such floating units and which allows facile disconnection of the units for whatever purpose.

Another object of the present invention is to provide a utility chase for floating units which has the flexibility of design to be placed in any configuration of floating units in a floating dock or wharf structure.

The invention possesses other objects and advantages especially as concerns particular features and characteristics thereof which will become apparent as the specification continues.

Various aspects of the present invention will evolve from the following detailed description of the preferred embodiments thereof which should be taken in conjunction with the accompanying drawings.

DETAILED DESCRIPTION OF THE PREFERRED EMBODIMENTS

Figure 1:
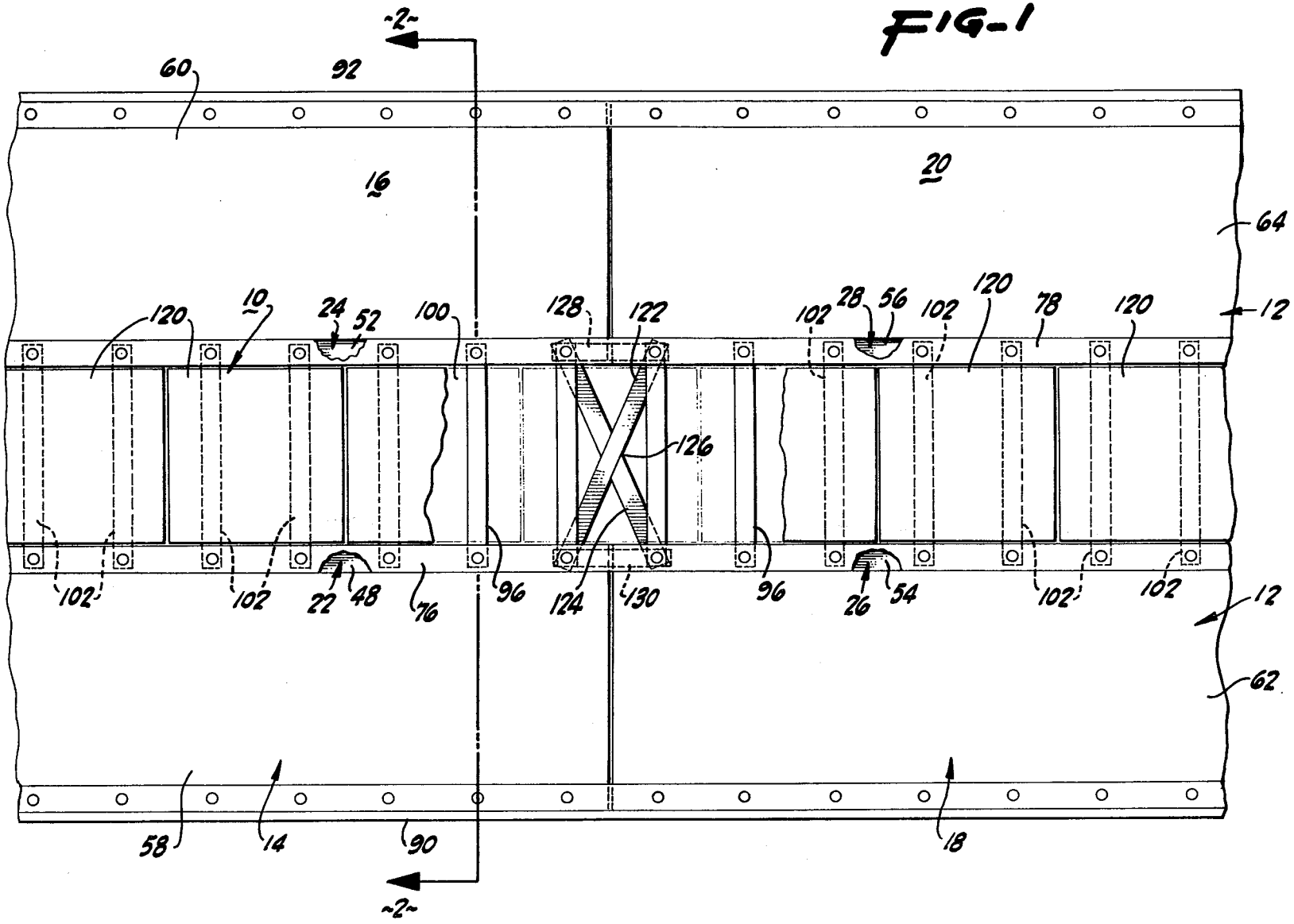
FIG. 1 is a top plan view of the invention, showing partially broken float unit panels.

With reference to the drawings, the apparatus as a whole is depicted by reference character 10 and includes as one of its elements a plurality of float units 12. Included in such plurality, are float units 14, 16, 18 and 20, designated first, second, third, and fourth float units respectively.

Figure 2:
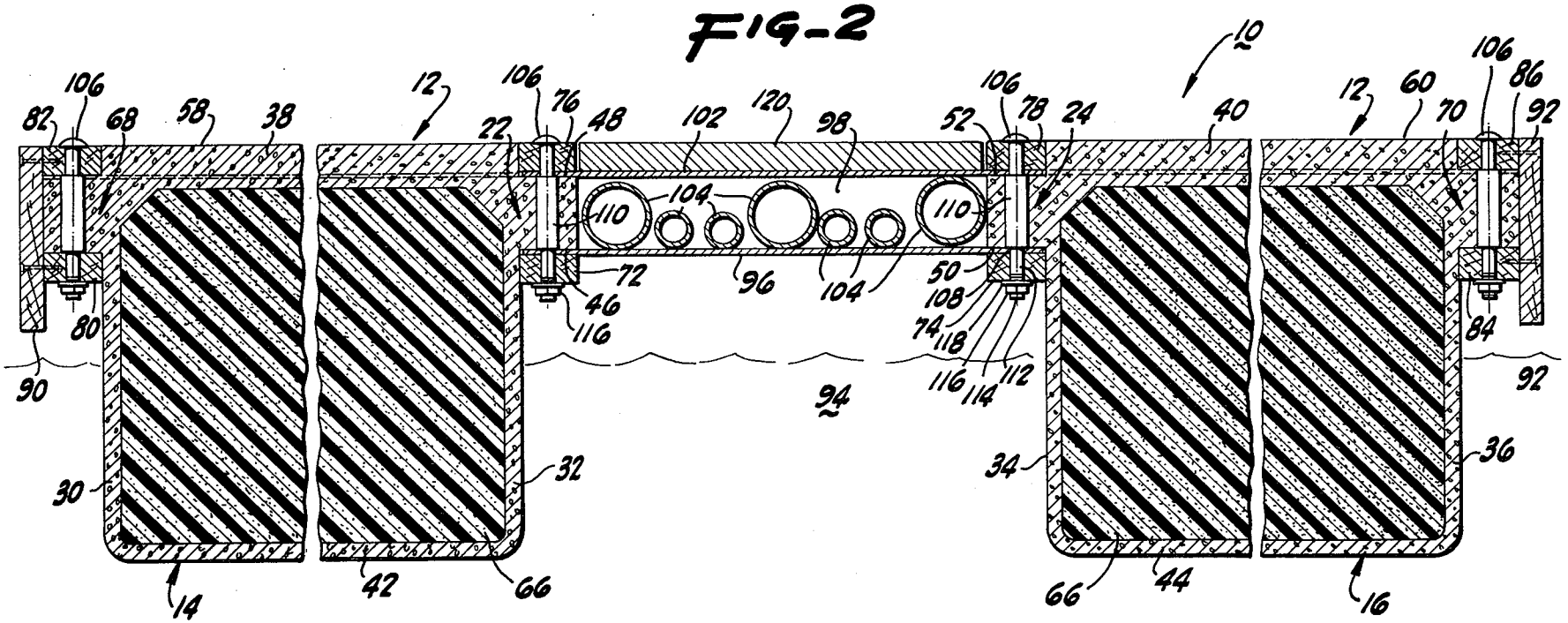
FIG. 2 is a view taken along line 2—2 of FIG. 1, showing partially broken float units.

Each of the float units has a flange structure 22, 24, 26, and 28 which extends along a side of each unit, FIGS. 1 and 2. Such flange structure is to be construed as a thickened portion of the side walls, side walls 30 and 32, and 34 and 36 of float units 14 and 16 being depicted on FIG. 2. Float units 14 and 16 are typical of all float units 14, 16, 18 and 20 described in the drawings, for the present embodiments. As shown, float units 14 and 16 also include tops 38 and 40 and bottoms 42 and 44. Flange structure 22 includes a first side 46 and a second side 48. Similarly, flange structure 24 has a first side 50 and a second side 52. First sides 46 and 50 have been chosen arbitrarily to be in a lower position than sides 48 and 52 of flange structures 22 and 24. It is deemed equivalent to assign the opposite notation to the side of the flange structures ie: the upper side being designated as the first side instead of the second side. In addition, the flange structures 26 and 28 for third and fourth float units 18 and 20 are constructed identically to the flange structure 22 and 24 heretofore described. FIG. 1 illustrates the flange structures 22, 24, 26, and 28 second sides 48, 52, 54, and 56 (the first sides of flange structures 26 and 28 are not shown, but are equivalent to first sides 46 and 50 of flange structures 22 and 24).

Each float unit includes an upper surface 58, 60, 62, and 64 which serves as a deck for pedestrian and vehicular traffic. In general, the floats may be constructed of any suitable material such as steel, wood, plastic, but concrete is the preferred material because of its strength, durability and ease of fabrication. The float units may be hollow or filled with expanded foam material 66 such as polystyrene, before or after casting of the concrete shell. Reinforcing steel may or may not be included within the concrete shell. Flange structures 22, 24, 26, and 28 extend along a side of each of the float units. On the opposite side of float units 14 and 16 from flange structures 22 and 24, are flange structures 68 and 70, FIG. 2.

First stringer 72 mounts against the first side 46 of flange structure 22 of float unit 14 and may extend and mount to the first side of flange structure 26 of the third float unit 18. Second stringer 74 mounts against the first side 50 of the flange structure 24 of second float unit 16 and may also extend and mount to the first side of flange structure 28 of fourth float unit 20. A third stringer 76 may mount against the second sides 48 and 54 of flange structures 22 and 26 found on first and third float units 14 and 18 respectively. Fourth stringer 78 may mount against the second sides 52 and 56 of flange structures 24 and 28, second and fourth float units 16 and 20. The float units may also have stringers 80, 82, 84, and 86 on the flange structures of the floats distal to the utility chase 10. These stringers aid in the interconnection of the float units and offer a base for side rails or bumpers 90 and 92. All stringers may be constructed of any rigid material, but wood is preferred because of its resistance to salt water corrosion. All the stringers perch above the level of water body 94 to further reduce contact with water body 94. Bumpers 90 and 92 may also be formed of wood, but plastic, hemp, and other shock absorbing materials will suffice.

At least one bar 96 of a plurality of such bars mounts against the first or second sides of flange structures 22 and 24, FIGS. 1 and 2. As depicted, bars 96 mounts against flange structure sides 46 and 50. FIG. 2 depicts bar 96 against the first sides 46 and 50 of flange structures 22 and 24. As heretofore noted, the flange structures of float units 14, 16, 18 and 20 are the same, hence the mounting of bar 96 as shown in FIG. 2 is the same for float units 18 and 20 when the utility chase extends beyond float units 14 and 16, which will be hereinafter detailed. It should be noted that the relationship of stringers 72 and 74 and bars 96 to sides 46 and 50 may be reversed, without detriment to the principal of the invention.

The flange structures 22 and 24 as well as 26 and 28 are spaced from each other to form a gap, hiatus, space 98 or the like, therebetween. Bar 96 partially enclosed the lower part of gap 96 to form a channel 100. As can be seen from the drawings, bars 96 span the space between flange structures 22 and 24. At least another bar 102, of a plurality of such bars, spans gap 98. Bars 96 and 102 space apart from one another to accomodate utility conduits 104 which may be of any conventional size eg: 12 centimeters in diameter.

Fastening means 106 secures first stringer 72, bar 96, flange structure 22, bar 102, and stringer 76 in compression. FIG. 2 details the preferred manner of constructing the fastening means 106. Drilled holes 108 through flange structures 22 and 24 contain imbedded sleeves 110 and holes 108. Sleeves 110 facilitate the replacement of bolts 108 that may fail or wear out. Threaded portions 114 of bolts 112 accept tightened nuts 116 and washers 118. Fastening means 106 used on flange structures 22 and 24 are equivalent to the fastening means 106 used to secure stringers 80 and 82 to flange structure 68, and stringers 84 and 86 to flange structures 70. As might be surmised from the drawings, fastening means can be utilized along the length of all the flange structures of the plurality of float units 12. In particular, channel 100 may extend to float units 18 and 20 as well as any number of float units thereafter.

The preferred embodiment shows a plurality of panels 120 substantially flush with the upper surfaces 58, 60, 62 and 64, which rest on bars 102, the flange structures have been recessed below the upper surfaces a distance of about the thickness of panels 120.

At the intersection of float units 12, 14, 16 and 18, in included a first crossbrace 122 mounted against the first or second sides of the flange structures and diagonally spanning the space between the first and fourth float units or the second and third float units. A second crossbrace 124 may be added to diagonally span the intersection between float units not traversed by the first crossbrace 122. The crossbraces 122 and 124 may be spot welded or otherwise fixed at point 126, where they approximate. Rigid straps 128 and 130 may be included to reinforce stringers 72, 74, 76 and 78 between the abutting float units 14, 16, 18, and 20. The fastening means 106 at the intersection corners of float units 14, 16, 18, and 20 would sandwich crossbraces 122 and 124, and rigid straps 128 and 130 as well as the stringers, flanges and bars, heretofore explained.

In operation, the float units 14, 16, 18, and 20 are manufactured and floated together in the body of coater 94. Stringers 72, 74, 76 and 78 as well as bars 96 and 102 are aligned with the drilled holes 108 through the flange structures 22, 24, 26, and 28. Space 98 is maintained as desired to accomodate the necessary utility conduits 104. Fastening means 106 is placed through the elements heretofore described in sandwich fashion and in compression, including the crossbraces 120 and 122 and rigid straps 128 and 130 at the corners of the float units' intersection. The utility conduits are placed in the channel 100 and panels 120 are used to cover the same.

While in the foregoing specification embodiments of the invention have been set forth in considerable detail for purposes of making a complete disclosure of the invention, it will be apparent to those skilled in the art that numerous changes may be made in such details without departing from the spirit and principles of the invention.

What is claimed is:

1. A utility chase for floating units comprising:

a. a plurality of float units each having a flange structure projecting therefrom, each of said flange structures extending along a side of each of said float units, said flange structure having a first and a second side, each of said float units having upper deck;

b. a first stringer mounted against said first side of said flange structure of a first float unit of said plurality of float units;

c. a second stringer mounted against said first side of said flange structure of a second float unit of said plurality of float units, said flange structure of said first float unit spaced from said flange structure of said second float unit;

d. at least one bar mounted against said first side of said flange structure of said first float unit, said at least one bar also mounted against said first side of said flange structure of said second float unit, said bar spanning the space between said first and second float units below said upper deck thereof;

e. fastening means for securing, in compression each of said flange structures of said first and second of said plurality of float units, said first and second stringers, and said at least one bar spanning the space between said first and second float units, said fastening means including a rod element extending through each of said first and second stringers and said at least one bar spanning the space between said first and second float units.

2. The utility chase of claim 1 which additionally includes a third stringer mounted against said second side of said flange structure of said first float unit a fourth stringer mounted against said second side of said flange structure of said second float unit, and at least another bar mounted against said second sides of said flange structures of said first and second float units, said fastening means securing in compression each of said flange structures of said first and second float units, said first and third stringers of said first float unit and said second and fourth stringers of said second float unit, and said at least one and another bars spanning the space between said first and second float units, said one and another bar spaced from each other to accomodate utility conduits therebetween.

3. The utility chase of claim 2 which additionally includes a panel removably positioned atop said at least another bar.

4. The utility chase of claim 3 in which said at least one bar comprises a plurality of bars.

5. The utility chase of claim 4 in which said at least another bar comprises a plurality of bars.

6. The utility chase of claim 2 in which said plurality of float units includes a third float unit and a fourth float unit, said third float unit abutting said first float unit with said first stringer additionally mounted against said first side of said flange structure of said third float unit, and said fourth float unit abutting said second float unit with said second stringer additionally mounted against said first side of said flange structure of said fourth float unit said flange structures of said third and fourth float units spaced from one another.

7. The utility chase of claim 6 which additionally includes a third stringer mounted against said second sides of said flange structures of said first and third float units and a fourth stringer mounted against said second sides of said flange structures of said second and fourth float units.

8. The utility chase of claim 7 which additionally includes a first crossbrace mounted against said first sides of said flange structures; said first crossbrace diagonally spanning the space between said first and fourth float units and secured in compression with said stringers by said fastening means.

9. The utility chase of claim 8 which additionally includes a second crossbrace mounted against said second sides of said flange structures said second crossbrace diagonally spanning the space selectively between said second and third float units.

10. The utility chase of claim 9 in which said first and second crossbraces secure to one another between their mounting points against said flange structures.

11. The utility chase of claim 7 which additionally includes a panel removably positioned atop said at least another bar.

12. The utility chase of claim 11 in which said at least one bar comprises a plurality of bars.

13. The utility chase of claim 12 in which said at least another bar comprises a plurality of bars.

14. The utility chase of claim 13 which additionally includes a first crossbrace mounted against said first sides of said flange structures said first crossbrace diagonally spanning the space selectively between said first and fourth units and secured in compression with said stringers by said fastening means.

15. The utility chase of claim 14 which additionally includes a second crossbrace mounted against said second sides of said flange structures, said second crossbrace diagonally spanning the space selectively between said said second and third float units, oppositely with respect to said first crossbrace.

16. A utility chase for a plurality of floating units comprising:

a. a first float unit having at least one side and an upper deck;

b. a second float unit having at least one side and an upper deck, said side of said first float unit being spaced from said side of said second float unit to form a gap therebetween;

c. at least one bar mounted to said at least one side of said first and second float units to span said gap therebetween below the level of said upper decks of said first and second float units, said at least one bar being supportive of utility conduits;

d. at least another bar mounted to said one side of said first and second float units, to span said gap therebetween below the level of said upper decks of said first and second float units, said at least one and another bars spaced from each other to accomodate utility conduits therebetween.

17. The utility chase of claim 16 in which said at least one bar comprises a plurality of said bars.

18. A utility chase for a plurality of floating units comprising:

a. a first float unit having at least one side and an upper deck;

b. a second float unit having at least one side and an upper deck, said side of said first float unit being spaced from said side of said second float unit to form a gap therebetween;

c. at least one bar mounted to said at least one side of said first and second float units to span said gap therebetween below the level of said upper decks of said first and second float units, said at least one bar being supportive of utility conduits;

d. a third and a fourth float unit each having at least one side and an upper deck, said third float unit abutting said first float unit and said fourth float unit abutting said second float unit; and e. a first crossbrace mounted to said first and fourth float units to span diagonally the space between said first and fourth float units below the level of said upper decks of said first and fourth float units.

19. The utility chase of claim 18 which additionally comprises a second crossbrace mounted to said second and third float units spanning diagonally said second and third float units below the level of said upper decks of said second and third float units.

20. The utility chase of claim 18 in which said at least one side of said third and fourth float units are spaced from each other to form a gap therebetween contiguous with said gap formed between said first and second float units; and additionally comprises at least one bar spanning said gap between said third and fourth float units below the level of said upper decks thereof.

* * * * *